US007306773B2

(12) United States Patent
Tanaka et al.

(10) Patent No.: US 7,306,773 B2
(45) Date of Patent: Dec. 11, 2007

(54) HOLDING MATERIAL FOR CATALYTIC CONVERTER

(75) Inventors: Masafumi Tanaka, Minato-ku (JP); Takahito Mochida, Hamamatsu (JP)

(73) Assignee: Nichias Corporation, Tokyo (JP)

( * ) Notice: Subject to any disclaimer, the term of this patent is extended or adjusted under 35 U.S.C. 154(b) by 678 days.

(21) Appl. No.: 10/656,325

(22) Filed: Sep. 8, 2003

(65) Prior Publication Data

US 2004/0062690 A1 Apr. 1, 2004

(30) Foreign Application Priority Data

Sep. 30, 2002 (JP) ..... P. 2002-285927

(51) Int. Cl.
*B01D 50/00* (2006.01)

(52) U.S. Cl. ..... 422/179

(58) Field of Classification Search ..... 422/179, 422/221

See application file for complete search history.

(56) References Cited

U.S. PATENT DOCUMENTS 4,698,213 A 10/1987 Shimozi et al. ..... 422/179
5,008,086 A * 4/1991 Merry ..... 422/180
6,077,483 A 6/2000 Locker et al. ..... 422/179

FOREIGN PATENT DOCUMENTS

| | | | |
|---|---|---|---|
| DE | 3638050 | A1 | 5/1988 |
| DE | 29518939 | U1 | 4/1996 |
| DE | 19753609 | A1 | 6/1999 |
| EP | 0 884 459 | A1 | 12/1998 |
| GB | 1473219 | * | 5/1977 |
| JP | 09242533 | * | 9/1997 |
| JP | 10-141052 | | 5/1998 |
| JP | 2002-66331 | | 3/2002 |
| JP | 2003-262117 | | 9/2003 |

* cited by examiner

*Primary Examiner*—Glenn Caldarola
*Assistant Examiner*—Tom Duong
(74) *Attorney, Agent, or Firm*—Nixon & Vanderhye P.C.

(57) ABSTRACT

A holding material used for a catalytic converter having a catalyst carrier shaped like a cylinder, a casing for receiving the catalyst carrier, and the holding material mounted on the catalyst carrier and interposed in a gap between the catalyst carrier and the casing, the holding material including a molding of inorganic fibers shaped like a mat or a cylinder, wherein at least an exhaust-gas-inlet-side end portion of the holding material is set to be smaller in basis weight than any other area of the holding material over a predetermined axial length.

6 Claims, 2 Drawing Sheets

HOLDING MATERIAL FOR CATALYTIC CONVERTER

BACKGROUND OF THE INVENTION

The present invention relates to a holding material for catalytic converter, for holding a catalyst carrier in a casing, and for use in a catalytic converter, for example, for purging exhaust gas emitted from an automobile or the like.

As known commonly, a catalytic converter for purging exhaust gas is mounted in a vehicle such as an automobile in order to remove emissions such as carbon monoxide, hydrocarbon and nitrogen oxides from exhaust gas emitted from an engine of the vehicle. Generally, as shown in FIG. 6 which is a sectional view, such a catalytic converter has a catalyst carrier 1 shaped like a cylinder, a metal casing 2 for receiving the catalyst carrier 1, and a holding material 3 interposed in a gap between the catalyst carrier 1 and the casing 2 while mounted on the catalyst carrier 1.

Generally, the catalyst carrier 1 has a cylindrical honeycomb molded material, for example, made of cordierite, and a precious metal catalyst carried by the molded material. It is therefore necessary that the holding material 3 interposed in a gap between the catalyst carrier 1 and the casing 2 has a function for holding the catalyst carrier 1 safely to prevent the catalyst carrier 1 from being damaged by collision with the casing 2 due to vibration or the like during the running of the automobile, and a function for sealing the catalyst carrier 1 to prevent non-purged exhaust gas from leaking out through the gap between the catalyst carrier 1 and the casing 2. Therefore, the holding material mainly used in the conventional art is a mat type holding material (e.g., see Japanese Application Publication Number 2002-66331 (JP2002-066331A)) of alumina fibers, mullite fibers or other ceramic fibers aggregated into a mat-like shape with a predetermined thickness, or a mold type holding material (e.g., see Japanese Application Publication Number Hei10-141052 (JP10-141052A)) molded into a cylindrical shape. Particularly the mold type holding material can be wound directly on the catalyst carrier 1, unlike the mat type holding material which has to be wound on the catalyst carrier 1 and supported by a tape or the like. Accordingly, the mold type holding material has an advantage to make it easy to produce the catalytic converter.

In order to obtain surface pressure necessary for holding the catalyst carrier 1, the holding material 3 is formed to have a basis weight (density) being not smaller than a fixed basis weight. Particularly in a diesel vehicle subject to rigid regulation of exhaust emission control, the catalyst carrier 1 is large in diameter, heavy in weight and high in exhaust pressure due to the influence of exhaust retarder. The holding material 3 is therefore requested to have a greater holding force. Thus, the holding material 3 is formed to have a considerably high basis weight.

Since the holding material 3 has inorganic fibers as its principal component, the gap between the fibers however nearly disappear when the basis weight of the holding material 3 increases. As a result, exhaust gas is blocked in the exhaust-gas-inlet-side end surface (e.g., a thick portion 3*a* on the left in FIG. 6) of the holding material 3. The exhaust gas contains plenty of acidic components such as NOx or SOx and flows in at a considerably high temperature and at a considerably high pressure. Thus, the exhaust-gas-inlet-side end surface 3*a* of the high basis weight holding material 3 potently suffers the wind erosion effect of the exhaust gas. As a result, the force that the holding material 3 has for holding the catalyst carrier 1 is lowered so that the catalyst carrier 1 is out of position. In the worst case, the catalyst carrier 1 may run into breakage.

SUMMARY OF THE INVENTION

It is therefore an object of the invention to provide a holding material for catalytic converter which is excellent in durability against the wind erosion effect of exhaust gas while keeping its ability to hold a catalyst carrier.

As a result of research carried out repeatedly to attain the foregoing object, the present inventors discovered that when a portion smaller in basis weight was provided in the exhaust-gas-inlet-side end surface of a holding material, the wind erosion effect of exhaust gas could be reduced while a catalyst carrier could be held by the other portion in the same manner as in the conventional art. Thus, the invention was completed.

That is, in order to attain the foregoing object, the invention provides a holding material, for a catalytic converter having a catalyst carrier shaped like a cylinder, a casing for receiving the catalyst carrier, and the holding material mounted on the catalyst carrier and interposed in a gap between the catalyst carrier and the casing, the holding material including a molding of inorganic fibers shaped like a mat or a cylinder, wherein at least an exhaust-gas-inlet-side end portion of the holding material is set to be smaller in basis weight than any other area of the holding material over a predetermined axial length.

DESCRIPTION OF THE PREFERRED EMBODIMENT

The invention will be described below in detail with reference to the drawings.

Figure 1:
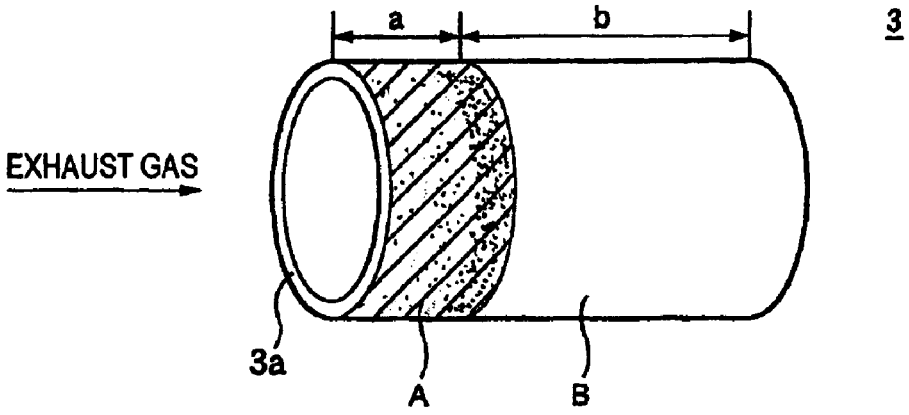
FIG. 1 is a perspective view showing an embodiment of a mold type holding material to which the present invention is applied.

FIG. 1 is a perspective view showing an embodiment of a mold type holding material to which the present invention is applied. As shown in FIG. 1, a mold type holding material 3 is molded into a cylindrical shape, with an area A smaller in basis weight than the other area B and formed over a predetermined axial length (a) from an exhaust-gas-inlet-side end surface 3 a of the mold type holding material 3. Incidentally, in the following description, the area A will be referred to as "low basis weight area", and the area B will be referred to as "high basis weight area".

In the low basis weight area A, the basis weight is reduced to set the density at a value low enough to prevent fibers from bending. Thus, the wind erosion effect in the exhaust-gas-inlet-side end surface 3*a* is reduced.

The basis weights of the low basis weight area A and the high basis weight area B and the ratio between the low basis weight area A and the high basis weight area B are set relatively to each other, respectively. As for the basis weights, when the basis weight of the low basis weight area A is set as 1, the basis weight of the high basis weight are a B is preferably not smaller than 1.15. In addition, as for the ratio for forming the areas A and B, it is preferable that the ratio of the axial length (hereinafter referred to as "width") (a) of the low basis weight area A to the width (b) of the high basis weight area B is in a range of from 1:9 to 9:1. The basis weights of the low basis weight area A and the high basis weight area B and the ratio for forming the low basis weight area A and the high basis weight area B are selected suitably to be in these aforementioned ranges so that the reduction of the wind erosion effect and the holding force can be achieved simultaneously.

Alternatively, the low basis weight area A may be formed so that the basis weight is the smallest in the exhaust-gas-inlet-side end portion 3*a* and increases continuously toward the high basis weight area B as shown with varied dot density in FIG. 1. In this case, the average basis weight of the low basis weight area A is regarded as the basis weight of the low basis weight area A and selected to be in the aforementioned range.

Figure 2:
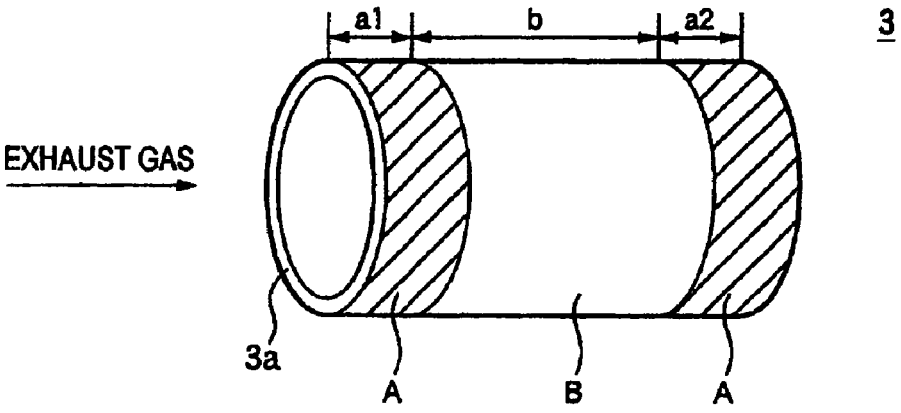
FIG. 2 is a perspective view showing another embodiment of the mold type holding material according to the present invention.

Further, the low basis weight area A may be provided in each of opposite end portions of the mold type holding material 3 as shown in FIG. 2. In this case, the two low basis weight areas A may be identical to each other or different from each other in basis weight and width (a1, a2). Incidentally, in order to secure the holding force of the catalyst carrier in the high basis weight area B, the total width (a1+a2) of the two low basis weight areas is selected to be in the aforementioned range. In addition, in the same manner as described above, each of the low basis weight areas A may be formed so that the basis weight is made the smallest in the open side end portion and increases continuously toward the high basis weight area B.

Figure 3:
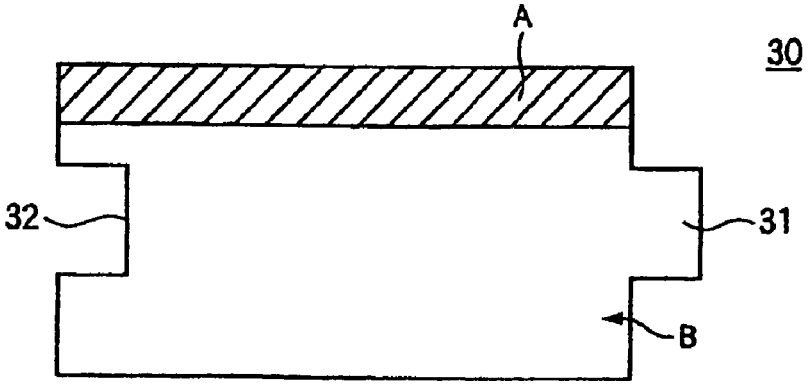
FIG. 3 is a top view showing an embodiment of a mat type holding material to which the present invention is applied.

The present invention is also applicable to a mat type holding material 30. FIG. 3 shows a plan view of the mat type holding material 30. The mat type holding material 30 shows a substantially rectangular planar shape having first sides (in the left/right direction of the paper plane in FIG. 3) defined to be substantially identical to the outer circumferential length of a catalyst carrier, and second sides (in the up/down direction of the paper plane in FIG. 3) defined to be substantially identical to the length of the catalyst carrier. Further, a lock piece 31 is formed in one of the second sides, and a recess portion 32 shaped correspondingly to the lock piece 31 is formed in the other second side. In addition, a low basis weight area A having a predetermined width is formed along one of the first sides.

When the mat type holding material 30 is in use, the mat type holding material 30 is wound on the outer circumferential surface of the catalyst carrier, and the lock piece 31 and the recess portion 32 are engaged with each other and fixed by a tape or the like. In such a mounting state, the mat type holding material 30 has the low basis weight area A located on one end surface side of the catalyst carrier in the same manner as in the mold type holding material 3 shown in FIG. 1. Incidentally, the width, etc. of the low basis weight area A is defined in the same manner as in the mold type holding material 3 shown in FIG. 1.

Figure 4:
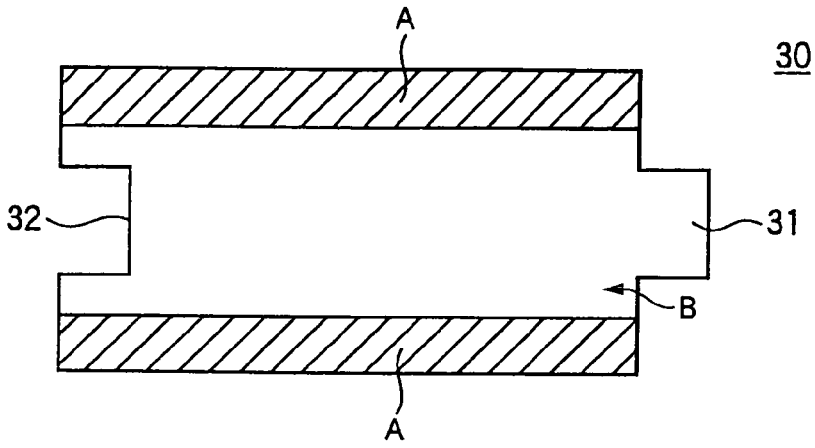
FIG. 4 is a top view showing another embodiment of the mat type holding material according to the present invention.

Alternatively, in the mat type holding material 30, the low basis weight area A may be formed along each of the first upper and lower sides as shown in FIG. 4. In the state where the mat type holding material 30 is mounted on the catalyst carrier, the two low basis weight areas A are located on the opposite end surfaces sides of the catalyst carrier respectively in the same manner as in the mold type holding material 3 shown in FIG. 2. Incidentally, the widths, etc. of the two low basis weight areas A are defined in the same manner as in the mold type holding material 3 shown in FIG. 2.

There is no restriction in the constituent material of each of the mold type holding material 3 and the mat type holding material 30. The constituent material may be similar to that of a holding material in the conventional art. The constituent material has inorganic fibers as its principal component, and the inorganic fibers are bound to one another by binder. As the inorganic fibers, various inorganic fibers used for holding materials in the conventional art may be used. For example, alumina fibers, mullite fibers or other ceramic fibers may be used suitably. More specifically, the material preferably used as the alumina fibers is fibers, for example, containing 90 wt % or more of $Al_2O_3$ (and $SiO_2$ as a residual component), having low crystallinity in terms of X-ray crystallography and having a mean fiber size of 3-7 μm and a wet volume of 400-1,000 cc/5 g. The material preferably used as the mullite fibers is a mullite composition, for example, having an $Al_2O_3/SiO_2$ weight ratio of about 72/28 to about 80/20, having low crystallinity in terms of X-ray crystallography and having a mean fiber size of 3-7 μm and a wet volume of 400-1,000 cc/5 g.

Incidentally, the wet volume is calculated by a method having the following steps:

(1) weighing 5 g of a dried fiber material by a weigher with accuracy of two or more decimal places;
(2) putting the weighed fiber material into a glass beaker having a weight of 500 g;
(3) putting about 400 cc of distilled water at a temperature of 20-25° C. into the glass beaker prepared in the step (2) and dispersing the fiber material into the distilled water (by an ultrasonic cleaner if necessary) while stirring carefully by a stirrer so that the fiber material is not cut;
(4) transferring the content of the beaker prepared in the step (3) into a 1,000 ml graduated measuring cylinder and adding distilled water into the graduated measuring cylinder up to the scale of 1,000 cc;
(5) ten-times repeating a process of stirring the content of the graduated measuring cylinder prepared in the step (4) by turning the graduated measuring cylinder upside down while blocking an opening of the graduated measuring cylinder with the palm of a hand carefully to prevent water from leaking out;
(6) measuring the sedimentation volume of fibers by eye observation after placing the graduated measuring cylinder quietly under room temperature for 30 minutes after the stop of the stirring; and
(7) applying the aforementioned procedure to three samples and taking an average of the measured values as a measured value.

Examples of the other ceramic fibers include silica-alumina fibers, and silica fibers. Known fibers as used in a holding material in the conventional art may be used as the other ceramic fibers. In addition, glass fibers, rock wool, or biodegradable fibers may be mixed with the inorganic fibers.

The binder is generally an organic binder. Rubbers compounds, water-soluble organic high-molecular compounds, thermoplastic resins, thermosetting resins, natural fibers (cotton, hemp, etc.), and the like, can be used. Specifically, examples of the rubber compounds include a copolymer of n-butyl acrylate and acrylonitrile, a copolymer of ethyl acrylate and acrylonitrile, a copolymer of butadiene and acrylonitrile, and butadiene rubber. Examples of the water-soluble organic high-molecular compounds include carboxymethyl cellulose, and polyvinyl alcohol. Examples of the thermoplastic resins include: homopolymers and copolymers of acrylic acid, acrylic ester, acrylamide, acrylonitrile, methacrylic acid, methacrylic ester, etc.; an acrylonitrile-styrene copolymer; and an acrylonitrile-butadiene-styrene terpolymer. Examples of the thermosetting resins include bisphenol epoxy resins, and novolac epoxy resins.

In addition, the following molding method may be adopted by way of example. That is, aqueous slurry containing inorganic fibers and organic binder is prepared. The aqueous slurry is vacuum-dehydrated and molded by use of a cylindrical mesh member (e.g., cylindrical wire gauze) when the mold type holding material 3 is molded, and by use of a tabular mesh member when the mat type holding material 30 is molded. After that, aqueous slurry molded thus is dried. At that time, the molding conditions are changed between the low basis weight area A and the high basis weight area B so that the basis weight ration of the low basis weight area A to the high basis weight area B is adjusted to be the aforementioned basis weight ratio. Alternatively, the slurry may be molded into a mat or a cylinder having a uniform basis weight all over the area. A high basis weight mat material molded separately is then laminated to and integrated with the molded slurry at the place where the high basis weight area B should be formed. The integration may be performed by sewing or needling as well as a method of bonding with organic binder, adhesive, double-sided tape or the like. Incidentally, sewing thread used for the sewing may be either inorganic or organic.

Incidentally, both the mold type holding material 3 and the mat type holding material 30 may be set to have any thickness appropriately in accordance with the size, the working temperature, etc. of a catalytic converter to which the holding material will be applied.

Figure 5:
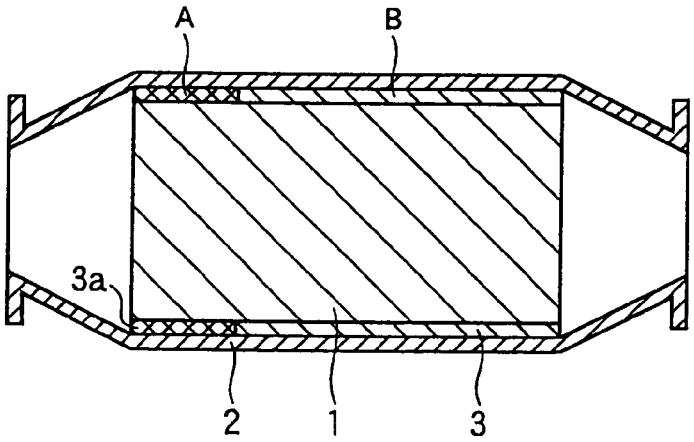
FIG. 5 is a sectional view schematically showing the configuration of a catalytic converter on which a holding material according to the present invention is mounted.
Figure 6:
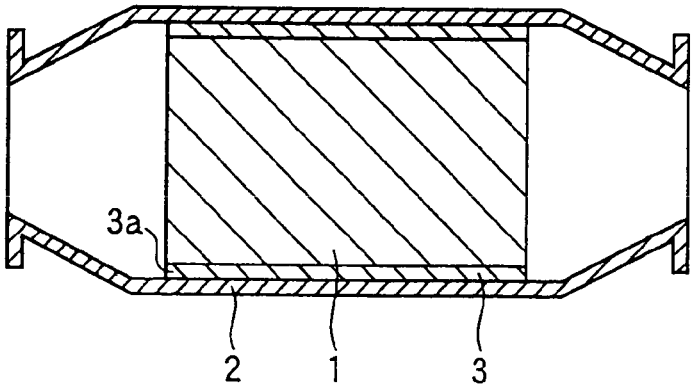
FIG. 6 PRIOR ART
FIG. 6 is a sectional view schematically showing the configuration of a catalytic converter in the conventional art.

The mold type holding material 3 or the mat type holding material 30 formed thus is wound on a catalyst carrier 1 and interposed in a gap between the catalyst carrier 1 and a casing 2 so that the low basis weight area A is located on the exhaust gas inlet side as shown in FIG. 5 (showing the mold type holding material 3 shown in FIG. 1 or the mat type holding material 30 shown in FIG. 3).

Incidentally, it is preferable that the density (gap density) of the mold type holding material 3 or the mat type holding material 30 mounted in the casing 2 is 0.25-0.4 g/cm3 in the low basis weight area A and 0.35-0.6 g/cm3 in the high basis weight area B. The basis weights of the low basis weight area A and the high basis weight area B in each holding material 3, 30 are set suitably in accordance with the gap between the catalyst carrier 1 and the casing 2, respectively.

EXAMPLES

The invention will be described below more specifically in connection with Examples and Comparative Examples. However, the invention is not limited to these examples at all.

Example 1

100 parts by basis weight of alumina fibers about 4 mm in fiber size, about 3 mm in fiber length, 96 wt % in Al2O3 content (and residual wt % in the SiO2 content) and 800 cc/5 g in wet volume, and 9 parts by basis weight of organic binder (acrylic emulsion) were dispersed into water so as to prepare aqueous slurry. Then, a cylindrical mold type holding material 225 mm in inner diameter, 8 mm in thickness, 50 mm in width (a) of a low basis weight area A and 100 mm in width (b) of a high basis weight area B as shown in FIG. 1 was obtained by a vacuum-dehydration molding method using a cylindrical wire gauze. Incidentally, the sucking force and the compressive force at the time of molding were adjusted so that the basis weight of the low basis weight area A was 1,300 g/m2 (gap density 0.325 g/cm3) and the basis weight of the high basis weight area B was 1,800 g/m2 (gap density 0.35 g/cm3).

Example 2

According to Example 1, a mold type holding material having low basis weight areas A in its opposite end portions was produced as shown in FIG. 2. Incidentally, the basis weight of each of the two low basis weight areas A was selected to be 1,300 g/m2 (gap density 0.325 g/cm3), and each width (a1), (a2) of the two low basis weight areas A was selected to be 25 mm. Incidentally, the basis weight and the width (b) of the high basis weight area B and the inner diameter and the thickness of the holding material were similar to those in Example 1.

Example 3

A mold type holding material was produced in the same manner as in Example 1, except that the low basis weight area A was formed so that the basis weight was controlled to be 1,300 g/m2 (gap density 0.325 g/cm3) in the open side end portion and to increase continuously and gradually up to 1,800 g/m2 (gap density 0.45 g/cm3).

Comparative Example 1

A mold type holding material having the same shape as that in Example 1 but having a fixed basis weight of 1,800 g/m2 (gap density 0.45 g/cm3) all over the holding material was produced.

Comparative Example 2

A mold type holding material having the same shape as that in Example 1 but having a fixed basis weight of 1,300 g/m2 (gap density 0.325 g/cm3) all over the holding material was produced.

Each holding material produced thus was mounted on a cordierite catalyst carrier of a cylindrical honey-comb structure having an outer diameter of 229 mm and a length of 150 mm, and further inserted into a stainless steel casing having an inner diameter of 237 mm (i.e., a gap between the casing and the catalyst carrier was 4 mm) and a length of 180 mm. Thus, a catalytic converter was produced. Incidentally, each of the holding materials according to Examples was disposed so that the low basis weight area was on the exhaust gas inlet side. Then, the catalytic converter was connected to an exhaust stack of a gasoline engine, and exhaust gas was distributed to the catalytic converter for 300 hours consecutively.

After the distribution of the exhaust gas, the catalytic converter was disassembled, and the existence of wind erosion in the holding material was evaluated by eye observation. Further the moving distance of the catalyst carrier in the casing was measured.

These results are shown in Table 1.

TABLE 1

| | existence of wind erosion | moving distance of catalyst carrier |
|---|---|---|
| Example 1 | no | 0.30 mm |
| Example 2 | no | 0.25 mm |
| Example 3 | no | 0.22 mm |
| Comparative Example 1 | conspicuous (damaged) | 3.45 mm |
| Comparative Example 2 | no | 5.42 mm |

As is apparent from Table 1, in Examples according to the invention, no wind erosion is observed in each of the holding materials and each catalyst carrier has little moved. Thus, the holding materials have excellent holding properties. On the other hand, in Comparative Example 1, the holding material was damaged badly due to wind erosion in the exhaust-gas-inlet-side end portion because the holding material as a whole is formed to be high in basis weight, and the catalyst carrier has moved in the casing. Thus, the holding material is inferior in holding performance. Further, in Comparative Example 2, there occurs no wind erosion in the holding material because the holding material as a whole is formed to be low in basis weight, and the catalyst carrier has however moved large in the casing due to the insufficient holding force of the holding material.

As described above, a holding material according to the invention is superior in durability against the wind erosion effect of exhaust gas while keeping its ability to hold a catalyst carrier.

What is claimed is:

1. A holding material, for a catalytic converter comprising a catalyst carrier, a casing for receiving the catalyst carrier, and the holding material mounted on the catalyst carrier and interposed in a gap between the catalyst carrier and the casing, wherein the holding material is made of inorganic fibers, at least an area of exhaust-gas-inlet-side of the holding material is set to be smaller in basis weight than any other area of the holding material, and wherein the gap between the catalyst carrier and the casing is substantially constant along an axial length of the catalytic converter.

2. A holding material for a catalytic converter according to claim 1, wherein when basis weight of a smaller basis weight area is set as 1, basis weight of the other area is not smaller than 1.15.

3. A holding material for a catalytic converter according to claim 1, wherein in a smaller basis weight area, basis weight is smallest at an open end portion of the holding material and increases continuously to reach the other area.

4. A holding material for a catalytic converter according to claim 1, wherein when average basis weight of a smaller basis weight area is set as 1, average basis weight of the other area is not smaller than 1.15.

5. A holding material for a catalytic converter according to claim 1, wherein a ratio, in axial length, of a smaller basis weight area to the other area is in a range of from 1:9 to 9:1.

6. The holding material for a catalytic converter according to claim 1, wherein the catalyst carrier has a constant diameter throughout its length.

* * * * *